US005539277A

United States Patent [19]

Jansma

[11] Patent Number: 5,539,277

[45] Date of Patent: Jul. 23, 1996

[54] FLUORESCENT LAMP HAVING HIGH RESISTANCE CONDUCTIVE COATING ADJACENT THE ELECTRODES

[75] Inventor: Jon B. Jansma, University Heights, Ohio

[73] Assignee: General Electric Company, Schenectady, N.Y.

[21] Appl. No.: 326,137

[22] Filed: Oct. 19, 1994

Related U.S. Application Data

[63] Continuation of Ser. No. 997,049, Dec. 28, 1992, abandoned.

[51] Int. Cl.[6] ..... H01J 61/35

[52] U.S. Cl. ..... 313/489; 313/635

[58] Field of Search ..... 313/489, 492, 313/635, 613, 614

[56] References Cited

U.S. PATENT DOCUMENTS

| | | | |
|---|---|---|---|
| 3,624,444 | 11/1972 | Witten et al. | 313/489 |
| 3,717,781 | 2/1973 | Sadoski et al. | 313/489 |
| 3,963,954 | 6/1976 | Mike et al. | 313/489 |
| 3,967,153 | 6/1976 | Milke et al. | 313/489 |
| 4,020,385 | 4/1977 | Lagos | 313/489 |
| 4,079,288 | 3/1978 | Maloney et al. | 313/489 |
| 4,293,594 | 10/1981 | Yoldas et al. | 427/107 |
| 4,363,998 | 12/1982 | Graff | 313/487 |
| 4,379,981 | 4/1983 | Rusch | 313/489 |
| 4,639,637 | 1/1987 | Taubner et al. | 313/487 |
| 4,857,798 | 8/1989 | Ford | 313/487 |
| 5,045,752 | 9/1991 | Jansma | 313/487 |
| 5,258,689 | 11/1999 | Jansma et al. | 313/489 |

*Primary Examiner*—Sandra L. O'Shea
*Assistant Examiner*—Matthew J. Esserman
*Attorney, Agent, or Firm*—George E. Hawranko; Stanley C. Corwin

[57] ABSTRACT

A fluorescent lamp includes a non-conductive metal oxide layer which cooperates with an overlying starting aid conductive layer to increase the latter's electrical resistance adjacent the lamp electrodes in order to suppress the occurrence of appearance defects associated with mercury condensation. A method of making the lamp includes forming the non-conductive layer along end portions of an inner wall of the lamp glass tube adjacent the electrodes.

15 Claims, 2 Drawing Sheets

FLUORESCENT LAMP HAVING HIGH RESISTANCE CONDUCTIVE COATING ADJACENT THE ELECTRODES

This is a continuation of application Ser. No. 07/997,049 filed Dec. 28, 1992, now abandoned.

BACKGROUND OF THE INVENTION

1. Field of the Invention

This invention relates to the elimination or reduction of appearance defects known as "measles", as defined hereinafter, in fluorescent lamps having a starting aid conductive layer or coating on the inner surface of the lamp tube or glass envelope.

2. Background of the Invention

Rapid-start or similar fluorescent lamps including a conductive layer, such as a tin oxide or indium oxide layer, and mercury vapor as part of the discharge sustaining gas fill are subject to the formation of localized appearance defects referred to as "measles." Such defects comprise a dark spot surrounded by a concentric ring of discoloration usually of the order of one or two millimeters in diameter. Measles are believed to develop during lamp operation as a result of an interaction involving the conductive layer and the mercury in arc discharge.

The occurrence of such appearance defects has been delayed in fluorescent lamps having a tin oxide conductive layer by varying the electrical resistance of the conductive layer along the axial length of the glass tube. More particularly, the electrical resistance profile of the conductive layer has been varied from a flat or constant value to a U-shaped or "bathtub" profile wherein a relatively low resistance value exists at the center portion of the lamp and relatively high resistance values exist at the end portions of the lamp. This profile is provided during lamp manufacture by making the tin oxide coating thicker at the ends of the lamp than at the middle of the lamp. This resistance profile in such lamp is a function of physical and chemical characteristics including thickness of the tin oxide layer applied directly to the inner wall surface of the lamp envelope or tube. The relative differences in electrical resistance along the axial length of the lamps achieved in this manner tend to decrease after about the first 500 hours of lamp operation. Moreover, the resulting variations in electrical resistance merely delay the occurrence of such defects from a time following the first 1000 hours of lamp operation to a later time after about 3000 to 4000 hours of lamp operation. This is a rather short improvement in the total life of the lamp which is of the order of about 20,000 hours. Accordingly, this process technique does not provide a satisfactory solution to such measle defects.

SUMMARY OF THE INVENTION

In accordance with the invention, an electrically non-conductive particulate layer or coating cooperates with the conductive layer to provide the latter with dissimilar electrical resistance properties along the length of the tube to suppress the occurrence of measles. The non-conductive coating is applied to portions of the inner wall of the tube of the fluorescent lamp at selected locations to modulate the electrical resistance of the overlying conductive coating at such locations.

The invention contemplates an improved fluorescent lamp having a variable resistance conductive coating on the inner surface of the glass lamp envelope or tube provided by the selective coating of the glass tube for the fluorescent lamp and a method for the production of such a tube and lamp. The lamp has a varying electrical resistance profile along the axial length of the inner surface of the tube or lamp. More particularly, the conductive coating disposed along the inner wall surface of the lamp envelope has a relatively high electrical resistance adjacent the end portions of the axial length of the tube or lamp, and a relatively low resistance adjacent the central or center portion of the axial length of the tube or lamp. The low resistance center portion allows the lamp to obtain the benefits of a rapid-start, energy efficient lamp, while the high resistance end portions aid in reducing the problem of measle defects associated with such coatings.

The resistance at the end portions of the tube may exceed the resistance at the central portion of the tube by up to an order of magnitude or more. In a four foot fluorescent lamp, the central portion resistance may be less than about 10 kiloohms/square and the end portion resistance may be more than about 150 kiloohms/square.

As indicated, the variable or dissimilar electrical resistance characteristics are achieved by applying the conductive coating over the particulate, non-conductive coating. The non-conductive coating is electrically non-conductive and it is believed to alter the effective electrical flow path and electrical resistance of the conductive coating. The non-conductive coating is characterized by a particulate composition. The non-conductive coating is selectively applied to the inner surface of the lamp envelope or tube along the axial length of the tube at locations of desired high electrical resistance. The particulate, electrically non-conductive coating may be applied at separate locations along the length of the tube in a segmented pattern.

The non-conductive coating may be a uniform continuous coating, but it must have a greater surface area on top of the coating than that of the underlying glass. In yet another embodiment, a precoat of particulate metal oxide may be first applied to the inner glass surface as a uniform coating along the length of the tube or envelope, over which is applied a second particulate coating at each end of the envelope which has a surface area greater than that of the precoat to provide a greater path (resistance) for the subsequent tin oxide coating. That is, while not wishing to be held to any particular theory, it is believed that the greater surface area results in an effectively greater resistance for the overlying thin layer of tin oxide.

The non-conductive coating may be formed of any inert particle suitable for incorporation in a fluorescent lamp. Such inert particles should be electrically non-conductive and should not affect fluorescent lamp operation except as contemplated in the invention. The inert particles should withstand the temperatures of fluorescent lamp manufacture which may range to within a few degrees of the melting point or distortion point of glass (e.g. 640° to 650° C.) or even higher. Preferably, the particle should be capable of deposition on the inner wall of the glass tube of the fluorescent lamp in a transparent, single particle thick layer.

A wide range of particle sizes may be used. Preferably, the particle is small enough to enable the formation of a particle suspension or dispersion in a fluid medium for deposition onto a surface such as the inner wall of the fluorescent lamp tube. Herein, such a particle is referred to as a colloidal particle. Preferably, the particles are suspended or dispersed in an aqueous liquid medium, and the presently preferred particle sizes have a major dimension in the range from about one nanometer to about 1500 nanometers, and, more preferably, in the range of from about one nanometer to about 750 nanometers. The average particle size is preferably about 300 nanometers.

Examples of suitable particles include metal oxides. Preferred metal oxides include alumina, silica, titania, yttria, zirconia, antimony oxide or combinations thereof. Alumina has been found to be particularly useful in the practice of the invention since it is electrically non-conductive, inert and readily available.

The non-conductive coating may be applied to the tube in any convenient manner including spraying, dipping and electrostatic techniques using current production equipment and coating technology. In the illustrated embodiment, a colloidal suspension of non-conductive particles is applied to selected portions of the inner wall of the glass envelope and dried to from the non-conductive coating. The conductive coating is formed uniformly over the entire axial length of the tube or lamp, and it directly overlies and contacts the non-conductive coating adjacent the end portions of the tube and the exposed inner wall adjacent the central portion of the tube. Thereafter, in most embodiments, a protective layer or barrier layer is applied to the conductive layer and the phosphor layer or coating is formed on the protective layer, and it is substantially coextensive with the latter. Additional layers of phosphor or other materials may be applied over the protective layer.

DETAILED DESCRIPTION

Figure 1:
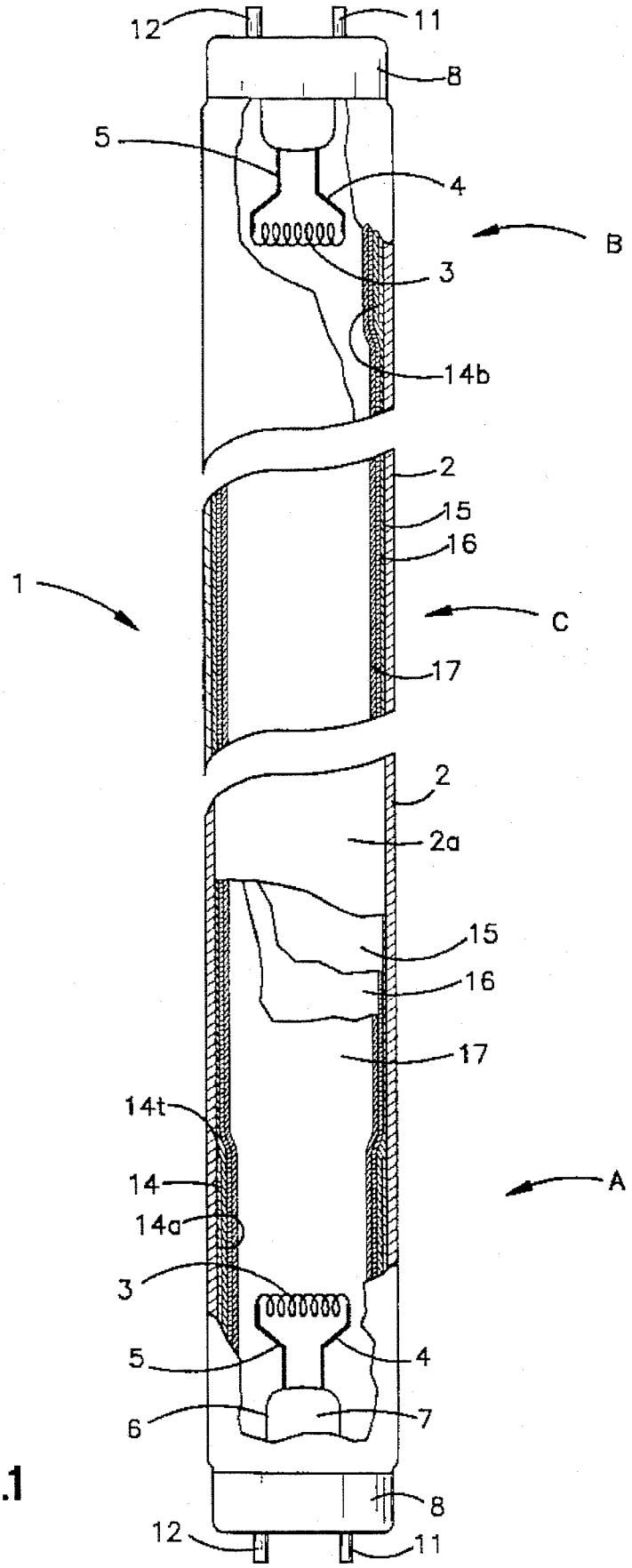
FIG. 1 is a diagrammatic perspective view, partially in section, of a low pressure mercury discharge fluorescent lamp utilizing a coating of metal oxide applied substantially only to the end portions of the lamp in accordance with the present invention.

Referring to FIG. 1, a fluorescent lamp 1 comprises an elongated, cylindrical-shape sealed glass envelope or tube 2 having electrodes 3 at each end. Envelope 2 contains a known discharge sustaining fill comprising mercury, together with an inert, ionizable gas. (not shown). Electrodes 3 are connected to lead wires 4 and 5 which extend through a glass seal 6 in a mount stem 7 to the electrical contacts of base 8 fixed at both ends of the sealed glass envelope. A pair of contact pins 11 and 12 extend from each of the bases 8, and are electrically connected to associated leads 4 and 5. The inert gas is typically argon or a mixture of argon and krypton at a low pressure of about $10^{-4}$ torr. The inert gas acts as a buffer or means for limiting the arc current.

The envelope 2 includes an inner wall 2*a* having a segmented first coating or layer 14 of metal oxide particles, a second or conductive layer 15 covering the layer 14 and any exposed portions of the inner wall 2*a* along the length of the tube 2, a protective or barrier layer 16 covering the layer 15, and a phosphor layer 17 covering the barrier layer 16. These layers are described more fully below.

The layer 14 comprises spaced segments 14*a* and 14*b* disposed adjacent associated end portions "A" and "B" at each end of the lamp 1. Each of the segments 14*a* and 14*b* extends from a location adjacent its associated electrode 3 toward the center of the envelope an axial distance selected to inhibit measle defects. For example, the layer segment 14*a* extends from the end of the lamp 1 to a terminal edge 14*t* adjacent the center portion of the lamp 1. Generally, the segments are of substantially equal axial length.

It is not necessary that segments 14*a* and 14*b* of the layer 14 have precise edges or boundaries, and irregularities may occur depending upon the manufacturing technique used to form the layer 14. However, the segments should be circumferentially continuous or otherwise arranged to provide the desired increase in electrical resistance. For example, each segment 14*a* and 14*b* extends an axial distance equal to from about 10% to about 25% of the total axial length of the envelope 2 or lamp 1, and, more preferably, a distance equal to about 20% of the total axial length of the envelope 2 or lamp 1. Thus, a 48 inch lamp may preferably have 20% of its length, or approximately 9.6 inches, adjacent each end of the tube coated with a layer of metal oxide particles. Conversely, in order to retain good startability and energy efficient operation, the low resistance, high conductivity, central portion of the lamp should preferably constitute approximately 50 to 80% of the total axial length, or 24 to 38.4 inches of the 48 inch lamp.

The layer 15 is preferably tin oxide, but may be formed of indium oxide or other conductive materials known in the art as an aid to rapid starting and energy efficiency. The thickness of layer 15 may vary somewhat along the axial length of the tube, but it is generally uniform within the known technological capabilities for applying such coatings to the inner wall of glass tubes for fluorescent lamps. The thickness of layer 15 is sufficient to provide the preselected parameters of startability and wattage consumption efficiency of the lamp.

The barrier layer 16 may be formed of any inert metal oxide known in the art to provide protection against general discoloration of the conductive layer during lamp operation. In the case of a tin oxide conductive layer, alumina has been found to provide effective protection as a barrier layer. Oxides of titanium, zirconium, hafnium, niobium and tantalum are also useful for forming the barrier layer. The barrier layer is coextensive with the conductive layer and may be applied by known methods.

The phosphor layer 17 is formed of phosphor materials known in the fluorescent lamp art. The phosphors may be applied in one or more layers, and may comprise more than one phosphor as well as known phosphor performance enhancers. The phosphor material constituting layer 17 may be applied by any known method suitable for application of phosphor materials over conductive materials to the inner wall of glass tubes for fluorescent lamps.

Known methods for applying coatings to the inner wall of glass tubes for fluorescent lamps include dipping in a liquid based suspension or dispersion, spraying, and by electrostatic methods. Layer 14 is formed by any of the known methods which can be sufficiently controlled to allow application only to the selected end portions of the glass tubes used for such lamps. Presently, the metal oxide is preferably applied from aqueous colloidal suspension or dispersion directly to the smooth glass inner wall 2*a* of the tube 2.

In one embodiment, the particulate metal oxide layer 14 is applied substantially one monolayer thick, where "one monolayer thick" means that the coating of metal oxide is intended to be applied in a layer no thicker than the diameter of the average particle of alumina in the colloid, and particles are not generally stacked upon one another. For example, if the average particle size of the alumina in a colloidal dispersion is two tenths of a micrometer in diameter, then the thickness of the alumina layer 14 on each end portion of the tube will likewise be an average of two tenths of a micrometer. A layer of metal oxide thicker than one monolayer will provide a fluorescent lamp within the bounds of the present invention, but it would be wasteful of material since one monolayer is sufficiently thick for achieving resistance modulation in accordance with the invention. Following application and drying of the colloidal metal oxide layer 14 to form segments 14*a* and 14*b* at the end portions "A" and "B" of the tube 2, the tube is coated along its axial length with the second layer 15 of low resistance conductive material. Layer 15 is applied at a substantially uniform weight per unit area over the first layer 14 comprising segments 14*a* and 14*b* and also the region of the inner wall 2*a* exposed adjacent the central portion "C" of the tube. Thus, the conductive layer 15 is applied directly to the glass inner wall 2*a* adjacent the central portion "C" of the tube 2.

The conductive material layer 15 may be applied by any of the known methods of applying such layers to glass tubes for fluorescent lamps. The preferred technique for applying layer 15 of conductive material is spraying. To that end, a spray head (not shown) is inserted a small distance into one end of the tube, and the entire axial length of the tube is spray coated with the conductive material. As a result of such spraying procedure, the conductive coating or layer 15 may be thicker at the end of the tube adjacent the spray head than at other portions of the tube. A corresponding difference may result in the electrical resistance of the conductive coating adjacent each end of the tube, but the resistance at each tube end portion will remain substantially higher than in the central tube portion. The slight differences in resistance at each tube end portion does not materially affect the invention.

Following the application of the layer 15 of conductive material, the barrier layer 16 is applied. Thereafter, one or more layers 17 of one or more phosphors are applied to the layer 16 along the length of the tube 2. The phosphor may be applied by any of the known methods of applying such materials to the inner wall of tubes for fluorescent lamps.

When the process of coating the inner wall is complete, the manufacture of the fluorescent lamp may then continue in known manner. The invention is further illustrated in the following non-limitative example.

EXAMPLE

A suspension of aluminum oxide for coating as the non-conductive, first layer on the inner wall of a glass tube for a 48 inch long fluorescent lamp was prepared as follows. Ten grams of Degussa-C colloidal alumina was stirred into one liter of distilled and deionized water to form an aqueous colloidal suspension of alumina in water. The alumina particles ranged in size from 5 to 1200 nanometers, and had an average particle size of about 300 nanometers. The concentration of the alumina is not critical, and it may range from 2.0–50 gram/liter. The amount used depends upon the drying conditions. The smallest effective amount of colloidal metal oxide is preferably used, consistent with the provision of the desired property of increased resistance in the end portions of the tube.

Approximately 10 inches at each end portion of the 1.5 inch diameter glass tube was dipped into the aqueous colloidal suspension, withdrawn, and then dried with hot air (80° C., 800 fpm) for approximately 7 minutes. The dried coated glass tube was then coated with tin oxide by the pyrolytic method to provide a uniform conductive layer extending along the axial length of the tube. A barrier layer of alumina was applied over the tin oxide layer to provide protection against general discoloration. A phosphor layer was then provided over the barrier layer. The resulting tube was incorporated into a fluorescent lamp, and the electrical resistance profile of the lamp is graphically shown in FIG. 2.

Figure 2:
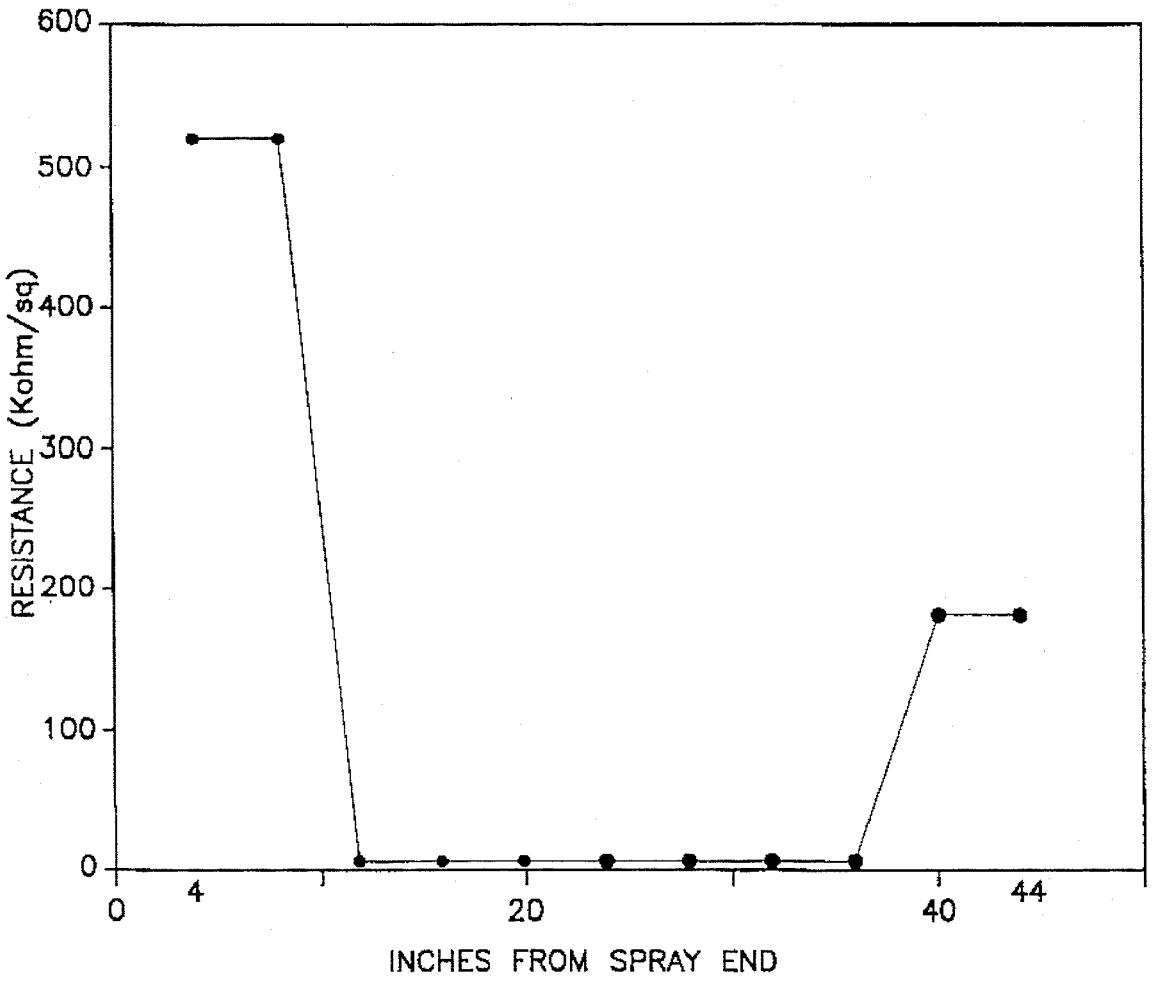
FIG. 2 is a graph showing the relationship between electrical resistance of the conductive layer or coating and location along the axial length of a glass tube in accordance with the invention.

FIG. 2 shows the increased resistance obtained in the end portions of the tube of the example. The electrical resistance of the conductive coating is graphically related to the axial length of the tube by a U-shape curve or "bathtub" profile wherein the high resistance adjacent the tube ends provide the legs of the U-shape curve and the low resistance adjacent the center of the tube provides the bight of the U-shape curve. In the absence of the non-conductive layer, it should be appreciated that the conductive layer has a substantially constant resistance equal to that at the center portion of the tube along the entire axial length of the tube or lamp.

As indicated by FIG. 2, a low resistance of approximately 4 kiloohms/square is achieved at the center or central portion "C" of the glass tube 2. Adjacent the end portions "A" and "B" of the tube 2, the resistance may range from about 180 to about 600 kiloohms/square. These variations in resistance properties have been found to suppress measle defects in accordance with the invention while maintaining good startability.

What is claimed is:

1. A fluorescent lamp comprising an elongated glass envelope having an axial length and an inner wall and end portions on opposed sides of a central portion thereof, an electrode at each of said end portions, a conductive layer having an electrical resistance and extending along said inner wall between said electrodes, a non-conductive layer extending along said inner wall at at least a select portion thereof which is less than the full length of said inner wall and said conductive layer and having a greater surface area than the underlying inner wall, a barrier layer overlying said conductive layer, and a phosphor layer on said barrier layer, said non-conductive layer altering the effective electrical flow path along the axial length of said envelope.

2. The lamp of claim 1, wherein said non-conductive layer cooperates with said conductive layer to increase the electrical resistance of said conductive layer adjacent said electrodes.

3. The lamp of claim 2, wherein said non-conductive layer extends between said inner wall and conductive layer adjacent each of said electrodes.

4. The lamp of claim 3, wherein said non-conductive layer comprises a layer of inert particulate.

5. The lamp of claim 3, wherein said non-conductive layer comprises a layer of at least one particulate metal oxide.

6. The lamp of claim 5, wherein said at least one metal oxide is selected from the group consisting essentially of alumina, silica, titania, antimony oxide, yttria and zirconia.

7. The lamp of claim 6, wherein said at least one metal oxide has a particle size in the range of from about one nanometer to about 1500 nanometers.

8. The lamp of claim 6, wherein said at least one metal oxide is alumina and said conductive layer is formed of tin oxide.

9. The lamp of claim 8, wherein said non-conductive layer has a thickness corresponding with that of substantially one layer of particulate metal oxide.

10. A fluorescent lamp comprising an elongated glass envelope having an axial length and an inner wall and end portions on opposed sides of a central portion thereof, an electrode at each of said end portions, a conductive layer formed of tin oxide and having an electrical resistance and extending along said inner wall between said electrodes, a non-conductive layer of particulate aluminum oxide, extending along from about 10 to about 25% of the axial length of said envelope between said inner wall and said conductive layer adjacent each of said end portions, having a thickness corresponding with that of substantially one layer of said particulate aluminum oxide, and having a greater surface area than the underlying inner wall, a barrier layer overlying said conductive layer, and a phosphor layer on said barrier layer, said non-conductive layer altering the effective electrical flow path along the axial length of said envelope.

11. The lamp of claim 10, wherein said non-conductive layer extends along about 20% of the axial length of said envelope adjacent each of said end portions.

12. The lamp of claim 11, including a discharge sustaining fill of mercury.

13. The lamp of claim 12, wherein said conductive layer has a resistance of about 150 kiloohms/square or more adjacent said central portion of said envelope and a resistance of about 10 kiloohms/square or less adjacent said central portion of said envelope.

14. A fluorescent lamp comprising an elongated glass envelope enclosing electrodes and a discharge sustaining fill of mercury, said envelope having an inner wall and end portions on opposed sides of a central portion, a segmented non-conductive layer on the inner wall adjacent each of said electrodes remote of said central portion, a conductive layer on said non-conductive layer and said inner wall at said central portion of said envelope, a barrier layer overlying said conductive layer, and a phosphor layer of said barrier layer, said non-conductive layer increasing the electrical resistance of said conductive layer adjacent said electrodes.

15. The lamp of claim 14, wherein said conductive layer comprises tin oxide and said non-conductive layer comprises at least one colloidal metal oxide selected from the group consisting essentially of alumina, silica, titania, antimony oxide, yttria and zirconia.

* * * * *